US010307634B2

(12) United States Patent
Young

(10) Patent No.: US 10,307,634 B2
(45) Date of Patent: Jun. 4, 2019

(54) PORTABLE FITNESS DEVICE

(71) Applicant: Jonathan James Young, Mesa, AZ (US)

(72) Inventor: Jonathan James Young, Mesa, AZ (US)

( * ) Notice: Subject to any disclaimer, the term of this patent is extended or adjusted under 35 U.S.C. 154(b) by 112 days.

(21) Appl. No.: 15/288,067

(22) Filed: Oct. 7, 2016

(65) Prior Publication Data

US 2017/0100624 A1 Apr. 13, 2017

Related U.S. Application Data

(60) Provisional application No. 62/284,683, filed on Oct. 7, 2015.

(51) Int. Cl.
*A63B 1/00* (2006.01)
*A63B 17/04* (2006.01)
(Continued)

(52) U.S. Cl.
CPC ..... *A63B 21/078* (2013.01); *A63B 17/04* (2013.01); *A63B 23/1218* (2013.01); *A63B 71/023* (2013.01); *A63B 1/00* (2013.01); *A63B 21/169* (2015.10); *A63B 21/4035* (2015.10); *A63B 2071/024* (2013.01); *A63B 2210/50* (2013.01); *A63B 2225/093* (2013.01)

(58) Field of Classification Search
CPC .. A63B 1/00; A63B 3/00; A63B 17/00; A63B 17/04; A63B 21/00185; A63B 21/002; A63B 21/0023; A63B 21/068; A63B 21/078; A63B 21/0783; A63B 21/08; A63B 21/15; A63B 21/159; A63B 21/16; A63B 21/169; A63B 21/4033; A63B 21/4035; A63B 23/04; A63B 23/0405; A63B 23/12; A63B 23/1218; A63B 23/1227; A63B 2023/0411; A63B 71/02; A63B 71/023; A63B 2071/024; A63B 2071/025; A63B 2071/026; A63B 2071/027; A63B 2208/0285; A63B 2210/00; A63B 2210/50; A63B 2225/09; A63B 2225/093
See application file for complete search history.

(56) References Cited

U.S. PATENT DOCUMENTS 4,789,156 A * 12/1988 D'Annunzio ..... A63B 63/083 280/727
5,558,608 A * 9/1996 Hall ..... A63B 21/0552 482/129
(Continued)

*Primary Examiner* — Gary D Urbiel Goldner
(74) *Attorney, Agent, or Firm* — Schmeiser, Olsen & Watts LLP

(57) ABSTRACT

A portable fitness device and methods of preparing the portable fitness device for use are described. The portable fitness device provides a stable and safe yet portable platform for performing resistance exercises in a variety of remote outdoor and indoor locations. Some versions of the portable fitness device include a bar clamped to an adjustable vertical attachment, so that a user can perform pull-up exercises from the bar. Some versions of the device include a bar rack for supporting a barbell loaded with weight plates. The portable fitness device may be coupled to a standard hitch receiver or other support and can be readily transported and used in a wide variety or outdoor and indoor settings.

11 Claims, 10 Drawing Sheets

(51) Int. Cl.

| | |
|---|---|
| ***A63B 21/00*** | (2006.01) |
| ***A63B 21/16*** | (2006.01) |
| ***A63B 23/12*** | (2006.01) |
| ***A63B 71/02*** | (2006.01) |
| ***A63B 21/078*** | (2006.01) |

(56) References Cited

U.S. PATENT DOCUMENTS 5,569,167 A * 10/1996 Friedli ..... A61H 3/00 482/51
5,573,238 A * 11/1996 Aaron ..... A63B 71/023 473/483
5,800,294 A * 9/1998 Naecker, Jr. ..... A63B 63/083 211/13.1
5,881,978 A * 3/1999 Rust ..... E04H 12/2215 109/52
5,902,195 A * 5/1999 Pavonetti ..... A63B 63/004 273/400
6,082,697 A * 7/2000 Grunfeld ..... A63B 63/004 248/156
6,419,596 B1 * 7/2002 Dadbeh ..... A63B 63/083 473/472
8,002,648 B1 * 8/2011 Quinn ..... A63B 69/0075 473/417
8,251,079 B1 * 8/2012 Lutz ..... A61H 3/04 135/67
9,216,314 B2 * 12/2015 Chen ..... A63B 21/16
9,320,934 B1 * 4/2016 Pringle ..... A63B 23/03558
10,024,487 B1 * 7/2018 Barenbrugge ..... F16M 13/02
2006/0148599 A1 * 7/2006 Haddix ..... A63B 63/00 473/535
2006/0186638 A1 * 8/2006 Varner ..... A63B 71/023 280/506
2008/0128463 A1 * 6/2008 Bryan ..... A63B 21/00047 224/486
2008/0220949 A1 * 9/2008 Yang ..... A63B 71/023 482/90
2009/0069161 A1 * 3/2009 Caldwell ..... A63B 21/00047 482/138
2010/0311024 A1 * 12/2010 Schenck ..... A63B 21/1681 434/258
2012/0172154 A1 * 7/2012 Icim ..... A63B 43/007 473/423
2012/0208682 A1 * 8/2012 Kueckelhan ..... A63B 23/0211 482/131
2013/0053220 A1 * 2/2013 Monaco ..... A63B 1/00 482/39
2013/0310232 A1 * 11/2013 Flores ..... A63B 17/00 482/131
2014/0296037 A1 * 10/2014 Razzaq ..... A63B 21/16 482/54
2015/0065316 A1 * 3/2015 Towley, III ..... A63B 21/00047 482/104
2015/0290488 A1 * 10/2015 Hopperstad ..... A63B 21/078 482/38
2015/0290518 A1 * 10/2015 Hudson ..... A63B 69/201 482/90
2018/0093151 A1 * 4/2018 Burdan ..... A63B 67/06

* cited by examiner

PORTABLE FITNESS DEVICE

CROSS REFERENCE TO RELATED APPLICATION

This application claims priority from U.S. Patent Application No. 62/284,683 filed Oct. 7, 2015 and entitled "Hitch Adaptor Fitness Device," which is incorporated entirely herein by reference.

BACKGROUND OF THE INVENTION

Technical Field

This invention generally relates to fitness devices. Specifically, this invention relates to a portable fitness device that couples to a vehicle towing hitch.

State of the Art

Fitness training is highly beneficial for overall health in essentially all age groups and a popular activity. Resistance training is a type of fitness training, which includes both body weight exercises, such as pullups, and weightlifting exercises. Effective resistance training confers many health benefits; particularly, increases in strength, muscle size, increased bone density, increased metabolic rate, and increased overall fitness. Variable combinations of standardized weight plates are mounted on opposing ends of a steel bar and held in place with removable collars are used to provide resistance for hundreds of different "free-weight" training exercises. Weight racks and exercise racks are available to facilitate resistance training exercises using either body weight or free weights. Examples include pullups, chest dips, leg squats and military shoulder presses.

Persons engaged in a program of resistance training seek to perform training exercises on a daily basis, including while travelling. Available weight racks, however, are generally large, heavy, bulky structures which are designed to be used in a fixed location and not readily portable. Further, racks designed for portability are lighter and consequently less stable than fixed racks, limiting the amount of weight which can be stably supported, whether in the form of plates on a barbell or the body weight of a person using the rack.

Accordingly, what is needed is a portable weight rack and exercise device system which is easy to assemble and disassemble, stable when in use, and readily portable with a vehicle.

SUMMARY OF THE INVENTION

The foregoing application describes a portable fitness device, including methods of deployment for use and methods of disassembly for transport. The fitness device, as disclosed herein, utilizes a trailer hitch coupled to a frame of the fitness device to stabilize the hitch as a point of support and generally immovable support structure for the device. The frame is additionally supported by non-fixed, adjustable members, such as vertical members, resting on or otherwise engaging a stable surface. Components of the portable fitness device are adjustable, wherein a portion of the weight of a vehicle bearing a hitch receiver for coupling to the portable fitness device acts to apply or transfer a force to the adjustable vertical members to firmly press the vertical members onto the stable surface. The portable fitness device may be used with various attachments in conjunction with options for adjustability, therein allowing a user to perform a vast array of resistance training exercises comparable to those available through use of existing, non-portable weight racks. The portable fitness device is able to safely support loads comparable to existing non-portable rack systems without moving or tipping over when an unbalanced load is present at least to a degree equal to that found in existing non-portable systems.

Disclosed is a portable fitness device comprising a connecting member; and a frame coupled to the connecting member, the frame comprising a horizontal member; an adjustable attachment coupled to the horizontal member; and a vertical member adapted to moveably couple with the adjustable attachment, wherein a ground end of the vertical member engages a stable surface.

In some embodiments, the vertical member comprises a first section adjustably coupled to the adjustable attachment; and a second section coupled to the first section.

In some embodiments, the adjustable attachment and the first section each comprise a plurality of holes, and wherein the first section is adjustably coupled to the adjustable attachment by a pin removably coupled through aligned holes of the adjustable attachment and the first section.

In some embodiments, the portable fitness device further comprises a bar connector coupled to the second section of the vertical member. In some embodiments, the portable fitness device of further comprises a rack member coupled to the vertical member. In some embodiments, the rack member is adjustably coupled to the vertical member.

In some embodiments, the frame comprises two horizontal members. In some embodiments, the frame further comprises a cross member coupled to the two horizontal members. In some embodiments, the connecting member is coupled to a receiver.

In some embodiments, the receiver is coupled to a vehicle. In some embodiments, the receiver is coupled to a post of a support. In some embodiments, the receiver is coupled to a ground auger.

Disclosed is a method of deploying a portable fitness device for use comprising the steps of mounting a connecting member of a frame comprising an adjustable attachment to a receiver coupled to a support; coupling a vertical member with the adjustable attachment; adjusting the vertical member with respect to the adjustable attachment; and locking the vertical member to the adjustable attachment.

In some embodiments, the support comprises a stationary vehicle. In some embodiments, the support comprises a post of a support. In some embodiments, the support comprises an auger support. In some embodiments, the method further comprises a step extending a second section of the vertical member with respect to a first section of the vertical member. In some embodiments, the method further comprises a step locking the second section with respect to the first section of the vertical member.

Disclosed is a method of transporting a portable fitness device comprising the steps of unlocking a vertical member from an adjustable attachment; disengaging the vertical member from the adjustable attachment; and stowing the vertical member for transport. In some embodiments, stowing the vertical member for transport comprises maintaining the frame coupled to a hitch receiver of the vehicle and coupling the vertical member to the frame.

The foregoing and other features and advantages of the invention will be apparent to those of ordinary skill in the art from the following more particular description of the invention and the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As noted herein above, embodiments of the present invention relate to fitness racks. Specifically, this invention relates to a fitness rack which couples to a vehicle towing trailer hitch receiver or similar receiver device. The capability to couple to a standard, widely available trailer hitch receiver facilitates fixation and stabilization of the portable fitness device when in use, following transport. Additionally, depending on the type of hitch receiver/hitch combination used, some embodiments of the portable fitness device are disassembled with the several pieces of the portable fitness device secured to a frame which remains coupled to a vehicle's hitch receiver during transport.

Figure 1:
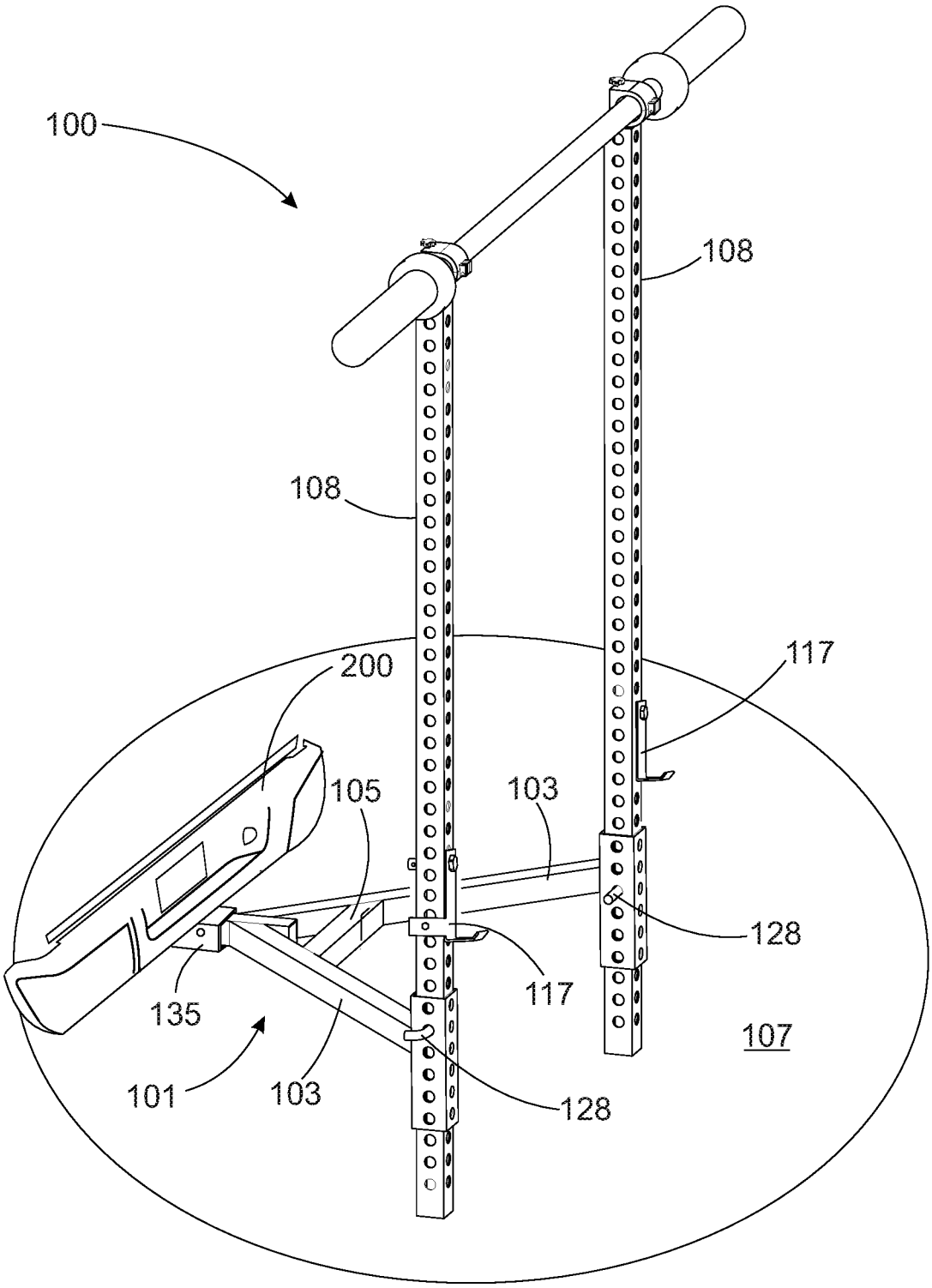
FIG. 1 is a perspective view of a portable fitness device coupled to a jack.

FIG. 1 is a perspective view of a portable fitness device coupled to a jack. FIG. 1 shows a perspective view of a portable fitness device 100 comprising a frame 101. Frame 101 is a foundational structural component of portable fitness device 100 and comprises a connecting member 102 removably coupled to a vertical member 108. A bar 125 is shown coupled to two vertical members 108 in the example embodiment shown in FIG. 1.

Because portable fitness device 100 is intended to be a readily portable device, coupling portable fitness device 100 to a stationary support while in use is important. A stationary support, such as a parked motor vehicle, a fixed post, or the like, provides a support structure for portable fitness device 100. It is understood that some support structures may be rigid, and among rigid support structures, some are more rigid than others. For example, a fixed post bolted to a concrete floor is essentially immobile, while a hitch receiver on an automobile or similar motor vehicle may be moved for a limited vertical or horizontal distance due to some "play" inherently present within the vehicle's suspension and drive system. Regardless, support structure is necessary for use with portable fitness device 100 in order to support several hundred pounds or more of weight while in use without shifting position or tipping.

Connecting member 102 operates to removably couple frame 101 of portable fitness device 100 to such a stationary support. In some embodiments, connecting member 102 comprises a square member that may be coupled to a hitch receiver attached to a vehicle, to a jack, to a support post, to an auger support and the like. It is to be understood that the embodiments shown and described in this disclosure are by way of example only and not meant to be limiting.

FIG. 1 additionally shows an example embodiment comprising two vertical members 108, which supports barbell 125. Vertical members 108 are adjustable with respect to frame 101 via an adjustable attachment 104, which is discussed in detail herein below (See discussion herein below of FIG. 2 and FIG. 4). The adjusting capability provided by adjustable attachment 104 allows for vertical member 108 to adjust in its position with respect to frame 101 while engaging a stable surface 107, shown in FIG. 1, to further support and maintain portable fitness device 100 in a substantially stable position during use, including under a condition wherein stable surface 107 is not level or is uneven. FIG. 1 additionally shows a rack member 117 for supporting a barbell 125.

Figure 2:
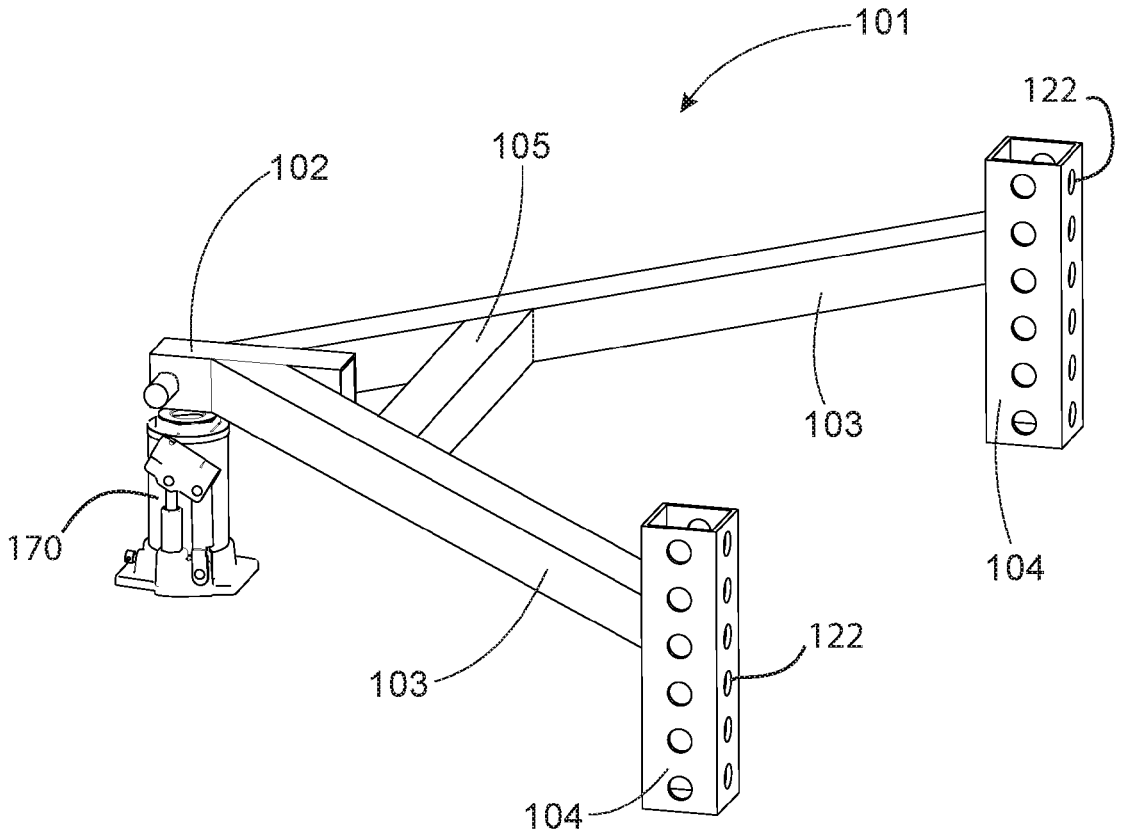
FIG. 2 is perspective view of a frame of a portable fitness device coupled to a jack.

As shown in FIG. 1 and FIG. 2, frame 101 comprises a horizontal member 103 coupled to an adjustable attachment 104. In some embodiments, such as the embodiment shown in FIG. 1 and FIG. 2, frame 101 comprises two horizontal members 103, each coupled to an adjustable attachment 104. Further, horizontal member 103 may also be coupled to connecting member 102. Frame 101 may additionally comprise a cross member 105 coupled to two horizontal members 103. The example embodiments of frame 101 shown in the drawing figures are not meant to be limiting, rather frame 101 may comprise two or more horizontal members 103, two or more cross members 105, or two or more horizontal members 103 and two or more cross members 105. The distinction between horizontal member 103 and cross member 105 is that horizontal member 103 is coupled to adjustable attachment 104 and cross member 105 is coupled a horizontal member 103, or an additional cross member 105. Unlike in the embodiment shown in FIG. 2, cross member 105 need not be coupled to two horizontal members.

For example, cross member 105, in some embodiments, is coupled to one horizontal member and an additional structure. The additional structure may include connecting member 102 or a second cross member 105. In some embodiments, a single horizontal member may be coupled at any point along its length to connecting member 102.

In some embodiments, horizontal member 103 is not coupled to connecting member 102, but coupled to cross member 105. Cross member 105 may be coupled to two horizontal members 103 and connecting member 102. Connecting member 102 may be coupled to two horizontal members 103. Connecting member 102 may be coupled to cross member 105 at any point along the length of cross member 105, and not to horizontal member 103.

Many possible configurations of frame 101 are possible within the scope of the invention. In some embodiments, the configurations of frame 101 include the generally open triangular shape shown in FIG. 1 and FIG. 2. In some alternative embodiments, frame 101 is configured in a rectangular shape, other polygonal shapes, or a combination of shapes within shapes similar to a system of trusses or related frame systems of load-bearing, force-distributing members coupled to one another, for example.

The elements of frame 101 are formed from materials which are generally strong and rigid. For example and without limitation, elements forming frame 101 may comprise metal or metal alloys, such as various steel alloys, which are rectangular in cross section. In some embodiments, elements of frame 101 are formed in an alternate polygonal, elliptical, or generally flat cross section. Further, elements forming frame 101 may be coupled to one another by welding; by fasteners, such as with screws, bolts, clips, clamps, or the like; by epoxy; by annealing; or the like. In some embodiments, elements forming frame 101 are fixedly coupled together. In some embodiments, elements forming frame 101 are removably coupled together. Additional possible materials used in the formation of frame 101 and means of coupling members of frame 101 together are further described herein below.

FIG. 1 and FIG. 2 show a jack 170 coupled to connecting member 102. In this example embodiment, jack 170 provides a means of supporting frame 101 of portable fitness device 100. A bottle-type hand-operated hydraulic jack is shown in the drawing figures, however this is not meant to be limiting. Other supports, including other types of jacks, bricks or cinderblocks, wood such as railroad ties, or other supporting means may be used to support connecting member 102 of frame 101.

Figure 3:
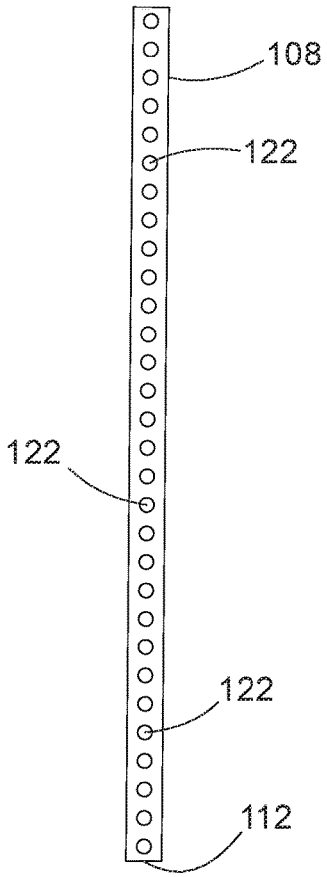
FIG. 3 is a side-view of a vertical member of a portable fitness device.
Figure 4:
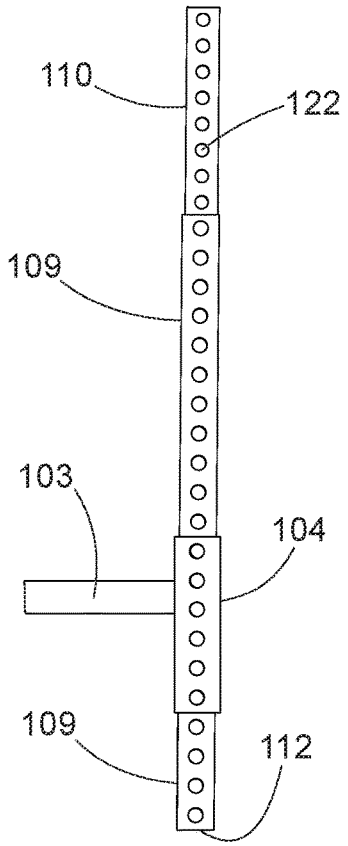
FIG. 4 is a side view of a vertical member engaged with an adjustable attachment of a portable fitness device.
Figure 5:
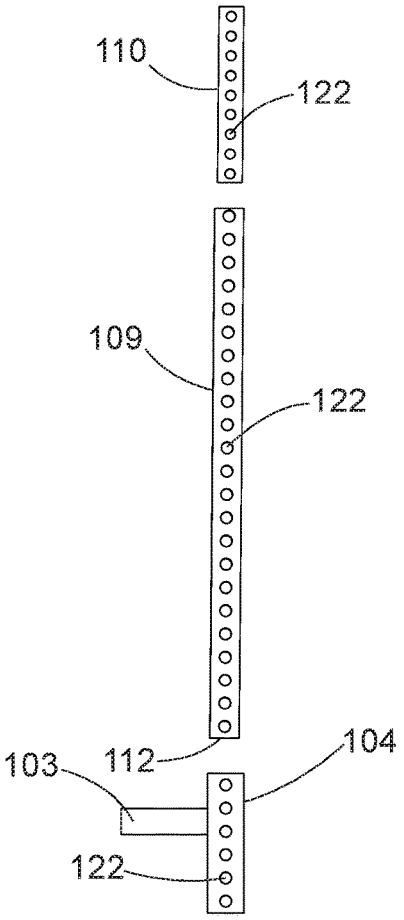
FIG. 5 is an exploded side view of a vertical member in proximity to an adjustable attachment of a portable fitness device.

FIG. 3 is a side-view of a vertical member of a portable fitness device; FIG. 4 is a side view of a vertical member engaged with an adjustable attachment of a portable fitness device; and FIG. 5 is an exploded side view of a vertical member in proximity to an adjustable attachment of a portable fitness device. As is shown by FIG. 3, FIG. 4, and FIG. 5, vertical member 108 may be coupled with adjustable attachment 104 in a sliding engagement, wherein vertical member 108 passes through an aperture of adjustable attachment 104. Vertical member 108 in this sliding engagement is an example of adjustably coupling vertical member 108 to adjustable attachment 104.

Figure 9:
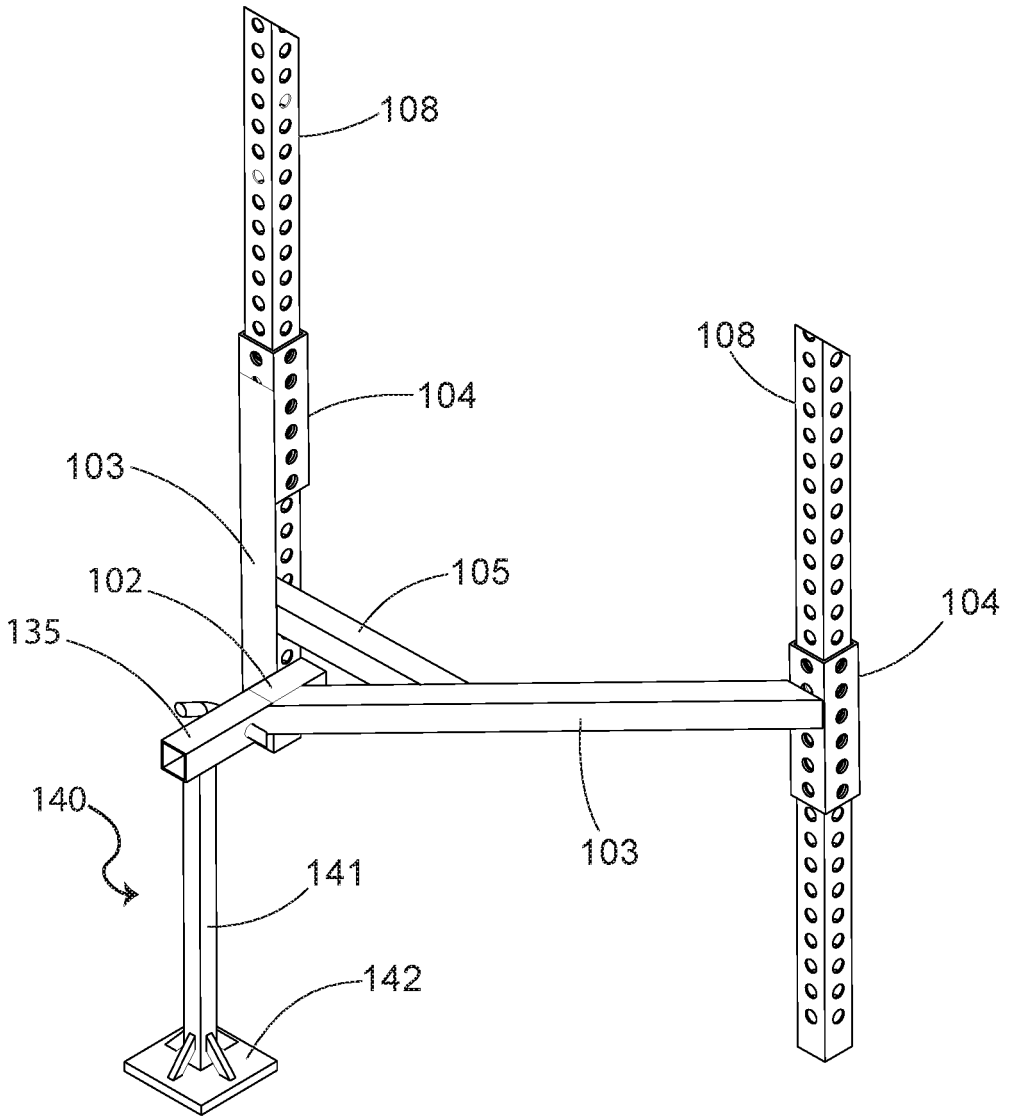
FIG. 9 is a perspective view of a portable fitness device coupled to a support.

As shown in FIG. 9, an embodiment of connecting member 102 is coupled to a support 140. In this embodiment, frame 101 is also coupled to vertical members 108 with adjustable attachment 104 to hold frame 101 generally in a horizontal plane. Vertical members 108 may be coupled with adjustable attachment 104 such that a ground end 112 of vertical member 108 engages stable surface 107. When portable fitness device 100 is in use, frame 101 is supported by support 140 and ground end 112 of vertical member 108 engaging a stable surface 107 (see FIG. 1), such as the ground, a parking lot or other paved surface; or a floor, such as can be found in the interior of a gym, a garage, a warehouse, a barn, and the like, for example. Adjustability of the coupling between vertical member 108 and adjustable attachment 104, in some embodiments allows for use of portable fitness device 100 on any variety of stable surface 107, including indoor surfaces, outdoor surfaces, paved surfaces; bare ground including soil, dirt, rock, sand, or gravel; lawn and similar outdoor planted surfaces; and the like. Embodiments of portable fitness device 100 may be used on sand at the beach, in a parking lot, on a basketball court, at a campground in the forest or the mountains, etc.

Each adjustable attachment 104 may be coupled to a horizontal member 103 and functions to adjustably couple with vertical member 108. The adjustable attachment 104 permits vertical member 108 to move with respect to adjustable attachment 104 such that ground end 112 of vertical member 108 is adjusted to engage stable surface 107, such as the ground, and to maintain the frame 101 in a generally horizontal plane prior to the use of portable fitness device 100. In the example embodiment shown in FIG. 4 and FIG. 5, and in some other embodiments, adjustable attachment 104 comprises a generally tubular member coupled to horizontal member 103 of frame 101. Neither the tubular nature of adjustable attachment 104 nor a sliding engagement between adjustable attachment 104 and vertical member 108 are meant to be limiting. In some embodiments, for example, the coupling means of vertical member 108 and adjustable attachment 104 is a combination of a groove feature located on either vertical member 108 or adjustable attachment 104 and a corresponding rail or pin-type component on either vertical member 108 or adjustable attachment 104. In some embodiments, adjustable attachment 104 may be a U-channel shape that receives vertical member 108 along a segment length of vertical member 108 through an open-side structure of adjustable attachment 104 (not shown). Some other embodiments of portable fitness device 100 comprise alternative means for engaging and coupling vertical member 108 to adjustable attachment 104.

Accordingly, when assembling portable fitness device 100 for use, vertical member 108 is moved in position with respect to adjustable attachment 104 to engage stable surface 107. In some embodiments (not shown by the drawing figures), ground end 112 of vertical member 108 is fitted with a pad, plate, foot, or analogous structure wherein vertical member 108 engages stable surface 107 through the pad, plate, foot, or analogous structure. Vertical member 108 and adjustable attachment 104 are then removably coupled to one another by an adjustment system. In some embodiments, this adjustment system comprises a plurality of holes 122 in adjustable attachment 104 corresponding to an additional plurality of holes 122 in vertical member 108. In these, and some other embodiments, a hole 122 of adjustable attachment 104 is aligned with a corresponding hole 123 in vertical member 108 and the aligned holes 122 and 123 are engaged by a pin 114 (as shown by FIG. 1), thus removably coupling vertical member 108 to adjustable attachment 104 and retaining the respective position of vertical member 108 with adjustable attachment 104. In some embodiments, adjustable attachment 104 and vertical member 108 do not comprise holes 122 and 123 respectively; rather, an alternative adjustable coupling system is employed to releasably couple adjustable attachment 104 to vertical member 108. For example, in some embodiments, vertical member 108 comprises a removable and adjustable compression clamp (not shown but discussed by way of example) placed on vertical member 108 at a point between adjustable attachment 104 and stable surface 107 where vertical member 108 exits adjustable attachment 104, thus removably coupling adjustable attachment 104 onto vertical member 108 in a manner to maintain engagement of ground end 112 of vertical member 108 with stable surface 107.

In the embodiment shown by FIG. 3, and in some other embodiments, vertical member 108 comprises a unitary body. In a non-limiting example, this unitary body is a single substantially elongated member formed of a rigid material, such as, but not limited to, steel or other suitable material and comprising a cross-sectional shape generally corresponding to adjustable attachment 104. In some other embodiments, however, vertical member 108 comprises a first section 109 and a second section 110, as shown by FIG. 4 and FIG. 5. In these, and some other embodiments, first section 109 comprises ground end 112. Second section 110 is telescopically coupled with first section 109 of vertical member 108. In some embodiments, second section 110 is detachable from first section 109 and may be completely removed for storage alongside first section 109, versus being stored in telescopic connection with first section 109.

In some embodiments, first section 109 and second section 110 each comprise an adjustment system wherein the position of second section 110 to first section 109 may be releasably fixed. For example, a user may choose to partially telescope second section 110 from first section 109 creating a total length (height) of vertical member 108 preferable to the user. The user then engages the adjustment system to releasably retain the position of second section 10 with respect to first section 9 to maintain the desired total length of vertical member 108. The user may then proceed to use portable fitness device 100 by engaging in various exercises. The total length of vertical member 108 chosen by the user will depend upon the height and body measurements of the particular user as well as the particular exercise the user is preparing to execute on portable fitness device 100. The adjustment system allows the user to easily and quickly change the total length of vertical member 108 comprising first section 109 and second section 110 between selected exercises. In some embodiments, such as those shown in the various drawing figures, for example, the adjustment system comprises a plurality of holes 123 in section 109 and a plurality of holes 124 in section 110 and a pin 118. In some embodiments, the pin 118 may be coupled to a rack member 117 (discussed further herein below; see FIG. 6 and FIG. 7). Hole 124 in second section 110 is aligned with corresponding hole 123 in first section 109 and pin 118 is then inserted through each of the aligned holes 123 and 124, retaining second section 110 in a position relative to first section 109 to create an overall length of vertical member 108 as chosen by the user. This example adjustment system comprising holes 123 in first section 109, holes 124 in second section 110 and pin 118 is not, however, meant to be limiting. Some embodiments of portable fitness device 100 comprise alternative adjustment systems for adjusting the overall length of vertical member 108, such as a compression collar adjusting means, corresponding screw threads between first section 109 and section 110, and the like. In some embodiments, pin 114, or a similar device, functions like pin 118 by passing through aligned corresponding holes 123 and 124 of first section 109 and second section 110 respectively to fix the relative position of first section 109 with respect to second section 110, wherein the overall length (height) of vertical member 108 is temporarily fixed. Such an adjustment system comprises a simple, sturdy, and generally safe and reliable adjustment means for allowing a user to determine an overall length (height) of vertical member 108 of portable fitness device 100.

In some embodiments, adjustable attachment 104 is a generally tubular structure such that, under a condition wherein portable fitness device 100 is in an assembled configuration, vertical member 108 slidably passes through an aperture extending through the tubular member of adjustable attachment 104. In some embodiments, adjustable attachment 104 is formed from similar materials as horizontal member 103 and cross member 105 of frame 101. In some embodiments, adjustable attachment 104 comprises a cross-sectional shape, such as the generally a rectilinear shape as shown in FIG. 2, similar to horizontal member 103. In some embodiments, adjustable attachment 104 comprises a different cross-sectional shape than horizontal member 103. Regardless, in the example embodiments shown in the drawing figures and some other embodiments, the cross-sectional shape and the shape of the aperture of the tubular member of adjustable attachment 104 must be of a compatible shape and size to receive vertical member 108 there through.

Figure 6:
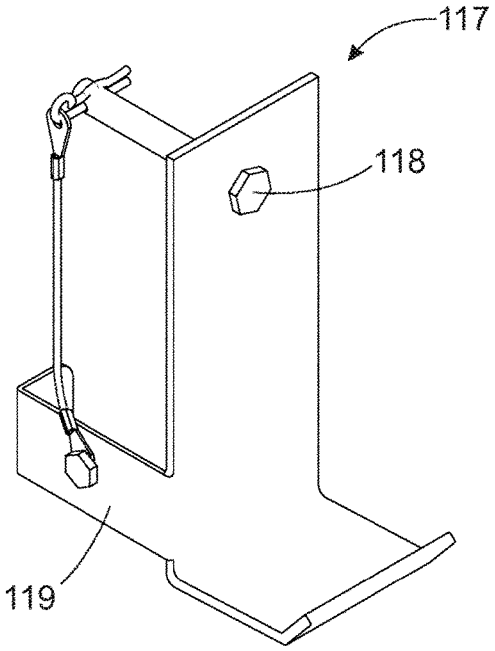
FIG. 6 is a perspective view of a rack member of a portable fitness device engaged with a barbell.
Figure 7:
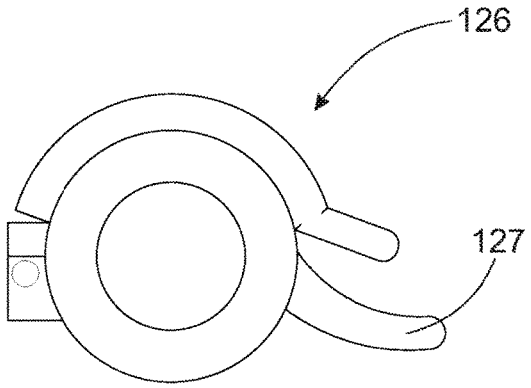
FIG. 7 is a perspective view of a rack member coupled to a vertical member of a portable fitness device.

FIG. 6 is a perspective view of a rack member 117 coupled to a vertical member 108 of a portable fitness device 100. As shown by FIG. 7 (and FIG. 1), rack member 117 may be coupled to vertical member 108 by inserting pin 118 through holes 122 of the vertical member, in some embodiments. Pin 118 removably couples rack member 117 on vertical member 108 in order to support the weight of bar 125 individually or loaded with weight plates (not shown). Side flange 119 rotationally stabilizes rack member 117 on vertical member 108 by preventing rotational movement in one direction or rack member 117 on pin 118. An example shape and configuration of rack member 117 is shown in FIG. 7, however this is not meant to be limiting. Other shapes of rack member 117 are possible which allow a barbell 125 to passively rest upon rack member 117 supported by vertical member 108 wherein the user of portable fitness device 100 may simply lift the barbell 125 free of rack member 117 to perform any variety of free-weight lifting exercises.

Figure 8:
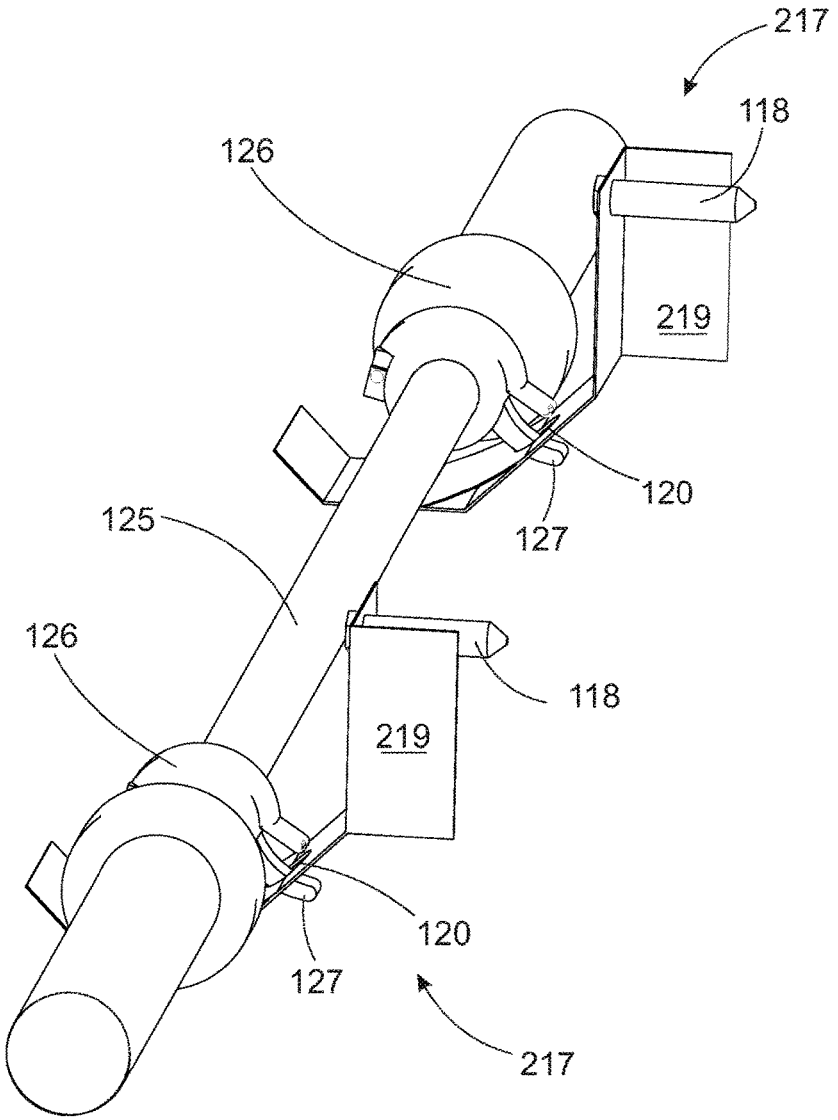
FIG. 8 is a side view of a barbell collar for a barbell used with a portable fitness device.

FIG. 7 is a side view of a barbell collar for a barbell used with a portable fitness device and FIG. 8 is a perspective view of a barbell rack coupled to a vertical member of a portable fitness device. FIG. 7 shows barbell collar 126 comprising collar pin 127. Barbell collar 126, in some embodiments, is coupled to bar 125 and facilitates stabilization of bar 125 on rack member 217 (see FIG. 8) by removably engaging collar pin 127 with aperture 120 of rack member 217. As shown by FIG. 8, bar 125 is resting on two racks members 217. Each rack member 217 may comprise a pin 118, a side flange 219 and an aperture 120. Aperture 120 may receive a collar pin 127 wherein bar 125 is stabilized on rack member 217. Collar pin 127 engages aperture 120, in some embodiments, to resist rotation or disengagement of bar 125 from rack member 217 during periods wherein a user of portable fitness device 100 wishes to rack a barbell 125, such as when resting between sets or between exercises. Rack member 217 supports a portion of a barbell 125 loaded with weight plates (not shown) on vertical member 108. This permits the user of portable fitness device 100 to lift a loaded barbell 125 up from a pre-established height off of rack member 217 in order to perform exercises such as a military shoulder press, squats, lunges, arm curls, and the like.

FIG. 9 is a perspective view of a portable fitness device coupled to a support. FIG. 9 shows an embodiment of a support 140 comprising a post 116 coupled to a receiver 135 at one end and fixedly coupled to stable surface 107 at the opposite end. Post 141, in some embodiments, is bolted to a concrete floor, such as an outdoor concrete surface like a parking lot, a patio, a concrete pad, and the like. Alternatively, post 141 is bolted to an asphalt-paved surface. Still other embodiments of support 140 comprise post 116 set directly in concrete, asphalt, or the like. In some embodiments, post 116 is coupled to a wall of a building or similar structure and juts out from the wall wherein receiver 135 is fixed in position to present a fixed mounting point for connecting member 102 of portable fitness device 100. Example descriptions found herein of the point and manner of fixation of post 116 are not meant to be limiting. In these and some other embodiments, connecting member 102 of portable fitness device 100 is coupled to receiver 135 of support 140, wherein frame 101 is rendered relatively fixed, stable, and immovable, preparing portable fitness device 100 for use.

Receiver 135 that receives connecting member 102 may be coupled to different supporting means, depending upon use of a particular embodiment of portable fitness device 100. For example, in some embodiments, receiver 135 is coupled to a vehicle. In some embodiments, receiver 135 is coupled to post 141 of support 140 coupled, in turn, to a paved surface, a floor, the ground, and the like. Examples of these embodiments are now discussed to illustrate the possible use of many different means of fixing and stabilizing portable fitness device 100 to a great variety of structures, including both outdoor and indoor structures and locations as already discussed herein above.

In such embodiments (as shown in FIG. 1) wherein receiver 135 is coupled to a vehicle 200, frame 101 is substantially fixed in position under a condition wherein frame 101 is coupled to the vehicle 200 via connecting member 102. In embodiments where receiver 135 is coupled to vehicle 200, receiver 135 may be a standard hitch receiver. The vehicle 200 may be any automobile, including, but not limited to, a car, a van, a pick-up truck, a sport utility vehicle, other kinds of trucks, or other vehicle bearing a hitch receiver. In these and some other embodiments, a portion of the vehicle's 200 weight, via the suspension system of the vehicle, is utilized to impart additional stability to portable fitness device 100. After engagement of stable surface 107 by vertical member 108 and prior to coupling vertical member 108 to adjustable attachment 104, upward pressure may be applied to frame 101 wherein the vehicle is lifted, somewhat, using the vehicle's suspension. Vertical member 108 is then coupled to adjustable attachment 104 and the upward pressure on frame 101 is released. In this manner, a portion of the vehicle's weight creates a force that is transferred to ground end 112 of vertical member 108, pressing ground end 112 against stable surface 107 and adding to the stability of portable fitness device when in use. In other words, in order to transfer a force from a portion of the weight of the vehicle or force from another support, the adjustable attachment 104 is coupled to the vertical member 108 in a position slightly above or otherwise above the horizontal plane of the frame, wherein the rigidity of the frame 101 transfers the force from the support to the vertical member 108.

Figure 10:
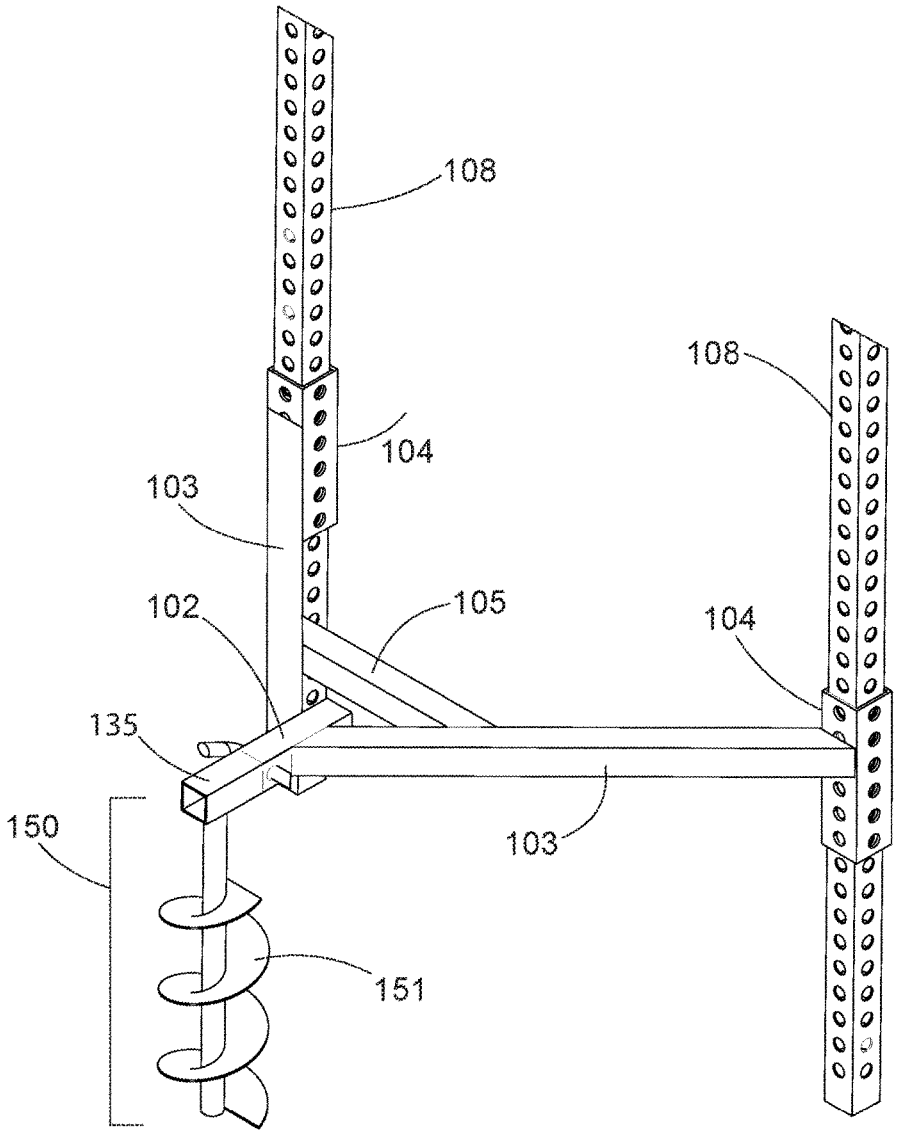
FIG. 10 is a perspective view of a portable fitness device coupled to an auger support.

Stabilization of portable fitness device 100 need not comprise coupling connecting member 102 to receiver 135 mounted on a vehicle. Alternatively, receiver 135 may be coupled to post 141 of support 140, wherein support 140 may be coupled to stable surface 107 by a mount 142, as shown in FIG. 9. In some embodiments, receiver 135 may be coupled to an auger support 150, as shown in FIG. 10 and discussed herein below. Examples wherein receiver 135 is not coupled to a vehicle 200, but rather is coupled to a post 141 or auger support 150 are discussed in greater detail herein below. It should be appreciated that portable fitness device 100 is stabilized for use in performing resistance training exercises in part by coupling connecting member 102 to receiver 135.

FIG. 10 is a perspective view of a portable fitness device coupled to an auger support. FIG. 10, shows an embodiment of a support comprising an auger support 150 having an auger 151. Auger support 150 is coupled to receiver 135 at one end and coupled to stable surface 107 at the opposite end by auger 151. When preparing receiver 135 for use on stable surface 107 which is unpaved, such as bare ground, a lawn, or the like, the user may couple auger support 150 to the stable surface 107 by operating auger 151 to screw auger 151 into stable surface 107. Once the auger 150 is coupled to the stable surface 107, the portable fitness device 100 may be assembled as previously described.

Figure 11:
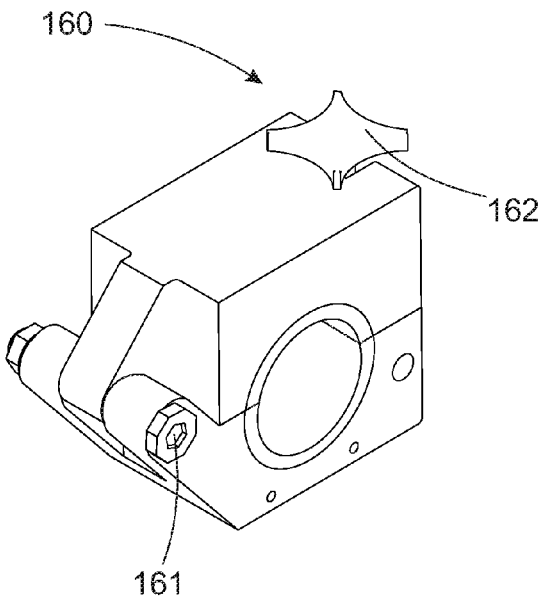
FIG. 11 is a perspective view of a barbell connector for a portable fitness device in a closed position.
Figure 12:
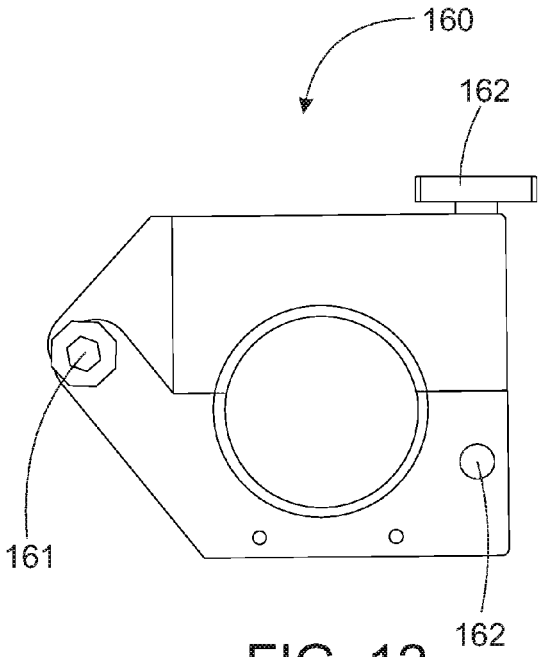
FIG. 12 is a side view of a barbell connector of a portable fitness device in a closed position.
Figure 13:
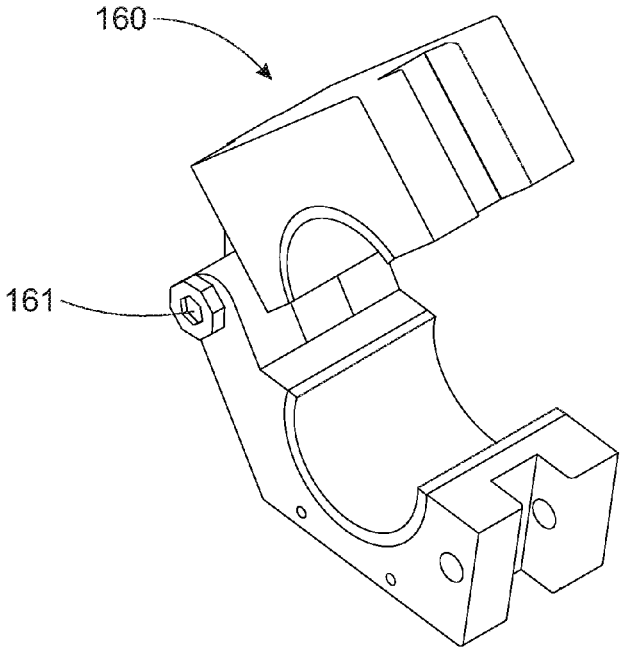
FIG. 13 is a perspective view of a barbell connector of a portable fitness device in an open position.

FIG. 11 is a perspective view of a barbell connector member of a portable fitness device, showing a bar connector 160. FIG. 12 is a side view of a barbell connector of a portable fitness device in a closed position; and FIG. 13 is a perspective view of a barbell connector of a portable fitness device in an open position. In some embodiments of the invention, bar connector 160 is coupled to vertical member 108 opposite and remote from ground end 112 as shown in FIGS. 1 and 2. Bar connector 160 removably couples bar 125 to either second section 110 of vertical member 108, or directly to vertical member 108. FIG. 11, FIG. 12, and FIG. 13 additionally show bar connector 160 comprising a connector hinge 161 and a bar lock 162. Bar connector 160 is a connecting means wherein bar 125 is linearly and rotatably fixed to vertical member 108, in some embodiments. It should be noted that bar 125 comprises any standard, commercially available barbell bar, in some embodiments, and that portable fitness device 100 may simultaneously comprises two bars 125—a bar 125 resting on rack member 117 and a second bar 125 coupled to bar connector 160. The structure and elements of bar connector 160 are provided by way of example only; alternative means to fix bar 125 to vertical member 108 may be used in some other embodiments.

Bar 125, in some embodiments, is a standard barbell bar. For example, bar 125 comprises a generally elongate, cylindrical steel bar with a cross-sectional diameter of between about 26 millimeters and 30 millimeters, by way of a non-limiting example. Bar connector 160, in some embodiments, may include a locking-jar collar, a bar-lock, a barbell lock, a bar clamp, and the like. Under a condition wherein bar 125 is clamped into position by bar connector 160, a user may utilize portable fitness device 100 to safely perform pull-up exercises, for example.

Figure 14:
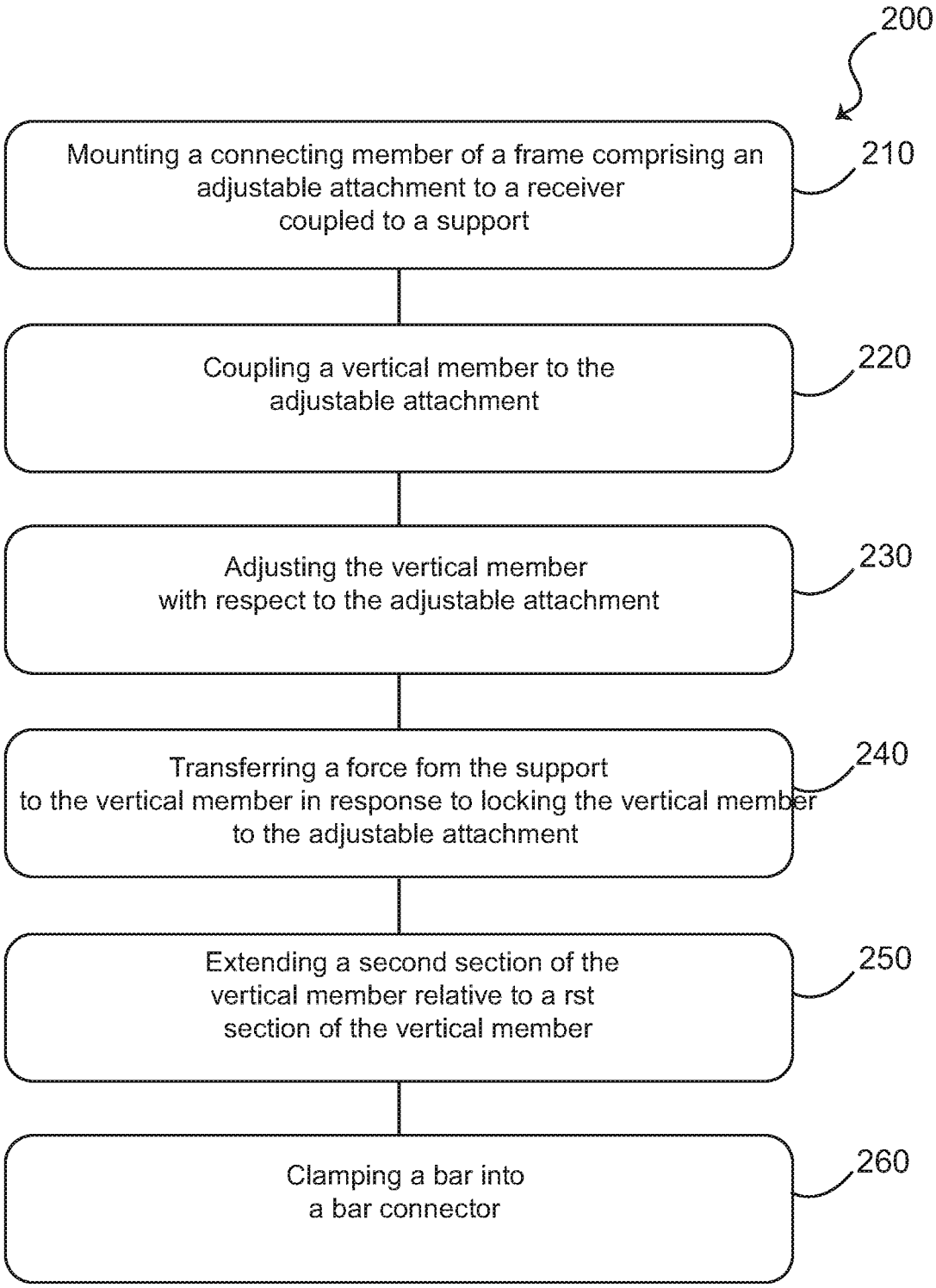
FIG. 14 is a flow-chart representing a method 200 of deployment for use of a portable fitness device.

FIG. 14 is a flowchart showing steps of a method 200 of preparing a portable fitness device for use. A portable fitness device may be deployed by a user in a variety of different locations with variable characteristic of the ground, pavement, or other stable resting surface upon which the portable fitness device rests and is to be used. Method 200 comprises a mounting step 210, a coupling step 220, an adjusting step 230, and a transferring step 240.

Mounting step 210 comprises mounting a hitch of a frame comprising an adjustable attachment to a receiver coupled to a support. As discussed herein above, mounting a portable fitness device to a receiver coupled to a support can take many forms, depending on the nature of the support. In some embodiments, mounting step 210 is performed outdoors. In some embodiments, including, for example, embodiments wherein the support is bolted to a floor surface of a garage, a warehouse, a gym, or the like, mounting step 210 is performed indoors. In some embodiments, mounting step 210 comprises a user inserting a connecting member into a receiver coupled to a support, such as a vehicle, a post, an auger support, or the like; and coupling the connecting member in the receiver, such as, but not limited to, by inserting a locking pin or similar locking means through both the connecting member and the receiver. Mounting step 210, however, need not be limited to a vehicle, as described in detail repeatedly herein. Moreover, the use of a hitch receiver mechanism is offered as an example only and is in no way intended to be limiting. Other suitable means, both commercially available and those which may become available in the future, for coupling the portable fitness device to a vehicle may also be used.

Coupling step 220 of method 200 comprises coupling a vertical member to an adjustable attachment. The vertical member may be coupled by engaging a pin through corresponding holes in the vertical member and the adjustable attachment. This is not meant to be limiting, but rather other coupling means may be utilized when performing coupling step 220, including but not limited, to rail-and-groove features, pin-and-groove features, and the like. Regardless of the particular coupling means used, coupling step 220 comprises the user engaging the vertical member with the adjustable attachment.

Adjusting step 230 of method 200 comprises adjusting the vertical members with respect to the adjustable attachments. In some embodiments, adjusting step 230 comprises moving the adjustable attachments with respect to the vertical members such that an adjustment system, such as corresponding holes in the adjustable attachment and the vertical member, become aligned and a pin inserted there through. During adjusting step 230, a ground end of the vertical member engages a stable surface and a frame of the portable fitness device is held in a generally horizontal plane in response to adjusting the vertical member with respect to the adjustable attachment. Again, as already discussed herein above, the stable surface may comprise the ground, a floor, a paved surface such as a parking lot or patio, a gym floor, a garage floor, and the like, without limitation. The only requirement is that the stable surface be relatively stable, meaning able to support the portable fitness device without substantial movement so as to render use of the portable fitness device unsafe. Some non-limiting examples of a stable surface are sand at the beach, loose gravel in a parking lot, and the like.

Transferring step 240 of method 200 comprises transferring a force from the support to the vertical member in response to locking the vertical member to the adjustable attachment. In some embodiments wherein the receiver is coupled to a vehicle, a portion of the weight of the vehicle may create a force that is applied through the frame of the portable fitness device and transferred to the ground end of the vertical member response to locking the vertical member to the adjustable attachment, thereby applying a force at the ground end against the stable surface in addition to the weight of the vertical member and force applied from the weight of the frame. In this and other such embodiments, the user exerts an upward force, either on the frame of the portable fitness device or on the vehicle prior to locking the vertical member to the adjustable attachment. Locking and then releasing the upward pressure causes the weight of the vehicle to transfer to the ground end of the vertical member.

In some embodiments, method 200 additionally comprises an extending step 250. Extending step 250, in some embodiments, comprises extending a second section of the vertical member relative to a first section of the vertical member. In some embodiments, extending step 250 comprises increasing the overall length (height) of the vertical member. In some embodiments, extending step 250 comprises coupling the second section with respect to the first section in the extended position by inserting a pin through corresponding holes of the first section and the second section of the vertical member. In some embodiments, coupling the second section with the first section in the extended position may be performed in other ways as previously described.

In some embodiments, method 200 additionally comprises a clamping step 260. Clamping step 260 comprises clamping a bar into a bar connector. In some embodiments, clamping step 260 comprises clamping a standard barbell bar into the bar connector.

Figure 15:
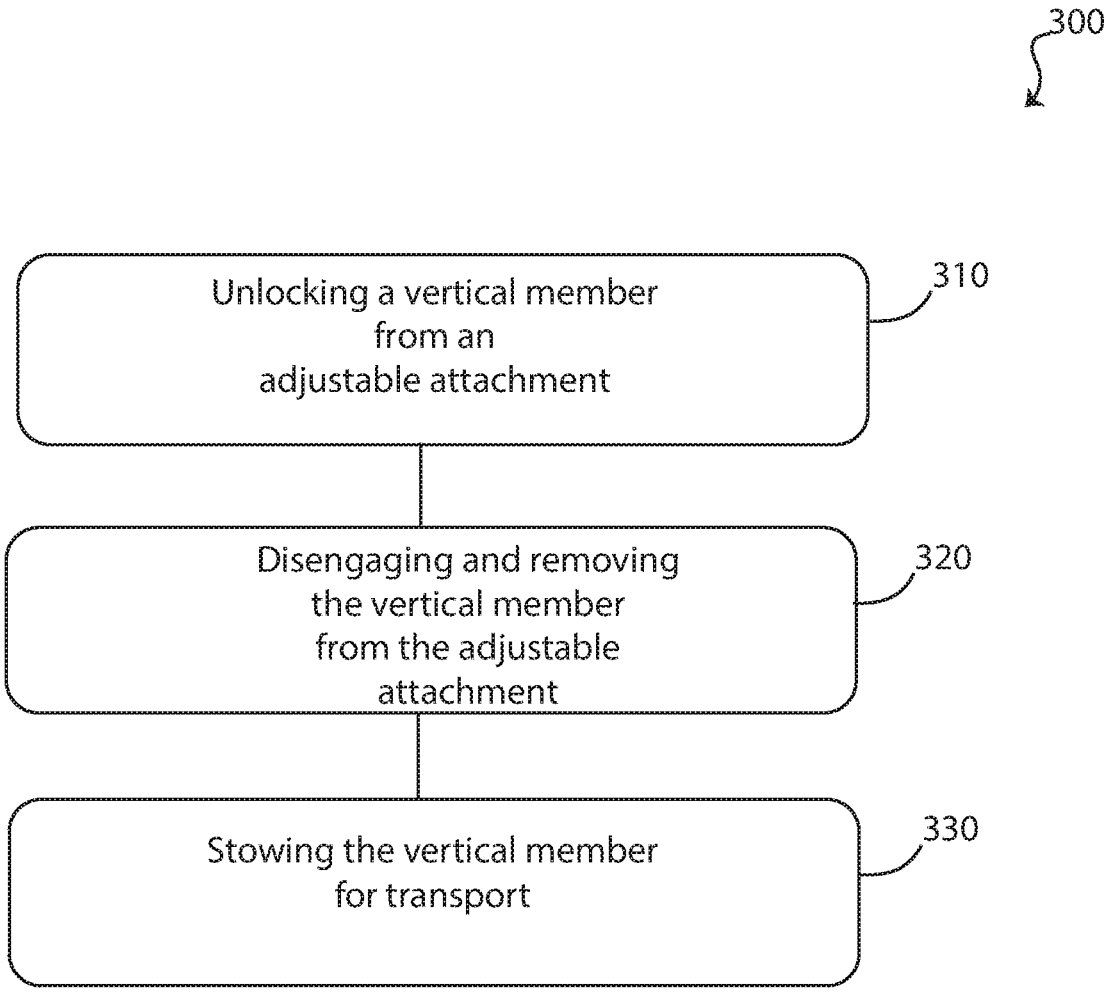
FIG. 15 is a flow-chart representing a method 300 of disassembly for transport of a portable fitness device.

FIG. 15 is a flow-chart representing a method 300 of disassembly for transport of a portable fitness device. Method 300 comprises an unlocking step 310, a disengaging step 320, and a stowing step 330.

Unlocking step 310 of method 300 comprises unlocking a vertical member from an adjustable attachment, in some embodiments. In some embodiments, unlocking comprises removing a pin. In some embodiment's, unlocking comprises releasing a clamp. In some embodiment's, unlocking comprise releasing an alternate locking means from vertical member or adjustable attachment.

Disengaging step 320 of method 300 comprises disengaging and removing the vertical member from the adjustable attachment.

Stowing step 330 comprises stowing the vertical member for transport. In some embodiments, stowing comprises coupling the vertical member to a frame of the portable fitness device in a stowed position. For example, in some embodiments, the frame is coupled to a hitch receiver of a vehicle, wherein the frame extends rigidly outward from the rear of the vehicle, wherein the frame supports one or two vertical members and additional components of the portable fitness device for transport behind the vehicle to form the stowed position.

A portable fitness device and methods of preparing the portable fitness device for use have been described. The portable fitness device solves the problems present in the prior art of providing a stable and safe yet portable platform for performing resistance exercises in a variety of remote outdoor and indoor locations.

The components defining any portable fitness device may be formed of any of many different types of materials or combinations thereof that can readily be formed into shaped objects provided that the components selected are consistent with the intended operation of a portable fitness device. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, and/or the like), any combination thereof, and/or other like materials; composites and/or other like materials; metals, such as titanium, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any portable fitness device may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A portable fitness device comprising:

a connecting member; and a frame coupled to the connecting member, the frame comprising:

two horizontal members, each having a first end and an opposing second end; two adjustable attachments directly and respectively coupled, in spaced horizontal relation to one another, to each of the two horizontal members; and two vertical members adapted to moveably and respectively couple with the two adjustable attachments, wherein a ground end of each of the two vertical members engages a stable surface; wherein the connecting member directly couples together the respective first ends of the two horizontal members; and wherein the connecting member and the two adjustable attachments elevate the two horizontal members a vertical distance above the stable surface.

2. The portable fitness device of claim 1, wherein each of the two vertical members comprise:

a first section adjustably and respectively coupled to one of the two adjustable attachments; and a second section coupled to the first section.

3. The portable fitness device of claim 2, wherein each of the two adjustable attachments and each of the first sections comprise a plurality of holes, and wherein each first section is adjustably and respectively coupled to the respective adjustable attachment by a pin removably coupled through aligned holes of the first section and the respective adjustable attachment.

4. The portable fitness device of claim 2, further comprising a bar connector coupled to the second section of each of the two vertical members.

5. The portable fitness device of claim 1, further comprising a rack member coupled to each of the two vertical members.

6. The portable fitness device of claim 5, wherein the rack member is adjustably coupled to each of the two vertical members.

7. The portable fitness device of claim 1, wherein the frame further comprises a cross member coupled to each of the two horizontal members.

8. The portable fitness device of claim 1, wherein the connecting member is coupled to a receiver.

9. The portable fitness device of claim 8, wherein the receiver is coupled to a vehicle.

10. The portable fitness device of claim 8, wherein the receiver is coupled to a post of a support.

11. The portable fitness device of claim 8, wherein the receiver is coupled to a ground auger.

* * * * *